United States Patent [19]

Rutherford

[11] 4,117,879

[45] Oct. 3, 1978

[54] FIXTURE FOR USE IN POSITIONING THE WALLS OF AN ADJUSTABLE CONTINUOUS-CASTING MOLD

[75] Inventor: Kenneth S. Rutherford, Oil City, Pa.

[73] Assignee: United States Steel Corporation, Pittsburgh, Pa.

[21] Appl. No.: 800,134

[22] Filed: May 24, 1977

[51] Int. Cl.[2] ..... B22D 45/00

[52] U.S. Cl. ..... 164/412; 164/339; 269/48.1

[58] Field of Search ..... 164/137, 412, 436, 339; 269/48.1

[56] References Cited

U.S. PATENT DOCUMENTS

| | | | |
|---|---|---|---|
| 3,292,216 | 12/1966 | Columbo | 22/57.2 |
| 3,330,021 | 7/1967 | Jacobsen | 269/48.1 |
| 3,331,723 | 7/1967 | Grace et al. | 269/48.1 |
| 3,375,865 | 4/1968 | Boichenko et al. | 164/283 |
| 3,439,736 | 4/1969 | Strohschein et al. | 164/273 |
| 3,863,356 | 2/1975 | Bengel et al. | 33/286 |
| 3,939,568 | 2/1976 | Gonos et al. | 33/143 L |

FOREIGN PATENT DOCUMENTS

| | | | |
|---|---|---|---|
| 1,223,503 | 8/1966 | Fed. Rep. of Germany | 164/137 |

*Primary Examiner*—Francis S. Husar
*Assistant Examiner*—John McQuade
*Attorney, Agent, or Firm*—Walter P. Wood

[57] ABSTRACT

A fixture for use in positioning the walls of an adjustable continuous-casting mold. The fixture includes a frame which is inserted in the mold and keys for engaging keyways in the upper and lower edges of the side walls of the mold to center the fixture. The fixture has positioning rods to be abutted by the adjustable end walls of the mold. The positioning rods are adjustable but remain equidistant from the center of the fixture.

6 Claims, 4 Drawing Figures

FIXTURE FOR USE IN POSITIONING THE WALLS OF AN ADJUSTABLE CONTINUOUS-CASTING MOLD

This invention relates to a fixture for use in positioning the walls of an adjustable continuous-casting mold.

A conventional continuous-casting mold includes an open-ended water-cooled sleeve through which liquid metal is poured. A partially solidified slab or billet of indefinite length emerges continuously from the bottom of the mold for further processing. Some molds have adjustable walls to permit their use in casting shapes of varying cross-sectional dimensions. It is known also to taper the walls of a continuous casting mold and to make the angle of taper adjustable. The fixture of the present invention is most useful for positioning adjustable walls in a mold used for casting slabs which are relatively wide compared with their thickness, but its use is not thus limited. Such molds have two narrow-face or end walls which are clamped between two broad-face or side walls. The positions of the end walls can be adjusted to vary the width of the slab, but the positions of the side walls are fixed, and the thickness of the slab can be varied only by using a different set of end walls. For showings of examples of such molds, reference can be made to Colombo U.S. Pat. No. 3,292,216, Boichenko et al U.S. Pat. No. 3,375,865, or Strohschein et al U.S. Pat. No. 3,439,736.

In a continuous-casting machine the mold is centered over a mold-discharge rack, which includes series of rolls engaging the four faces of a slab or billet. When adjustments are made in the positions of the end walls of the mold, there is a problem in adjusting the walls accurately to the new dimension and in centering the adjusted mold over the guide roll-rack.

An object of the present invention is to provide a fixture which enables the end wall of an adjustable continuous-casting mold to be positioned accurately and the mold to be centered accurately with each adjustment.

A further object is to provide a fixture which enables such adjustments to be made expeditiously and eliminates need for laborious measurements.

Figure 2:
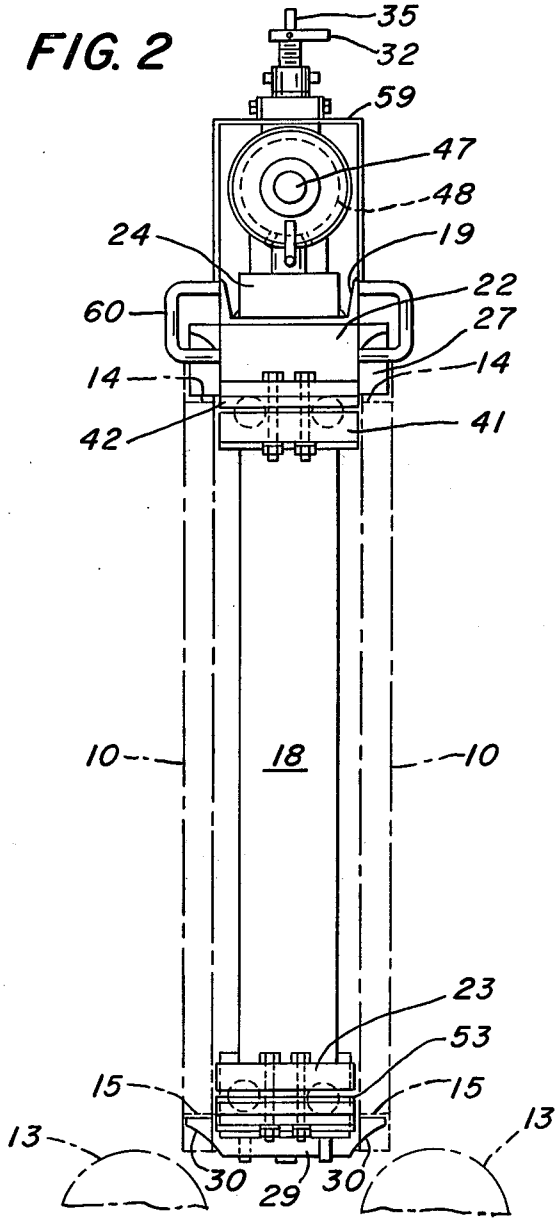
FIG. 2 is an end elevational view of the fixture and mold, and the uppermost rolls of a mold discharge rack.

The drawings shown in phantom lines a continuous-casting mold, which has opposed side and end walls 10 and 12 respectively, and the uppermost rolls 13 of a mold discharge rack. The end walls 12 are clamped between the side walls 10, and their position is adjustable as known in the art. The upper and lower edges of the side walls have keyways 14 and 15 at their centers to center the fixture, as hereinafter explained.

The fixture of my invention includes a rigid rectangular frame formed of opposed vertical members 18, top and bottom horizontal members 19 and 20, and a diagonal brace 21. The vertical members 18 and top member 19 are fixed to upper corner blocks 22. Similarly the vertical members and bottom member 20 are fixed to lower corner blocks 23.

At its midportion the top member 19 of the frame carries an upstanding housing 24 and a depending upper bearing member 25. The bottom member 20 of the frame carries a lower bearing member 26, likewise at its midportion. The exterior of the upper bearing member 25 carries a top centering key 27 which is fixed thereto and extends sideways in both directions. A vertical shaft 28 is mounted in the two bearing members 25 and 26 for rotational and axial movement. The lower end of shaft 28 carries a bottom centering key 29 which has cutouts 30 in its lower edge (FIG. 2). The lower face of the lower bearing member 26 has keyways 31 which extend sideways for receiving key 29. The upper end of shaft 28 carries a bottom key indicator bar 32 and has a screw-threaded portion 33 immediately below the bar. A nut 34 is engaged with the threaded portion 33 and bears against the top of the housing 24. The nut carries a crank 35.

Figure 1:
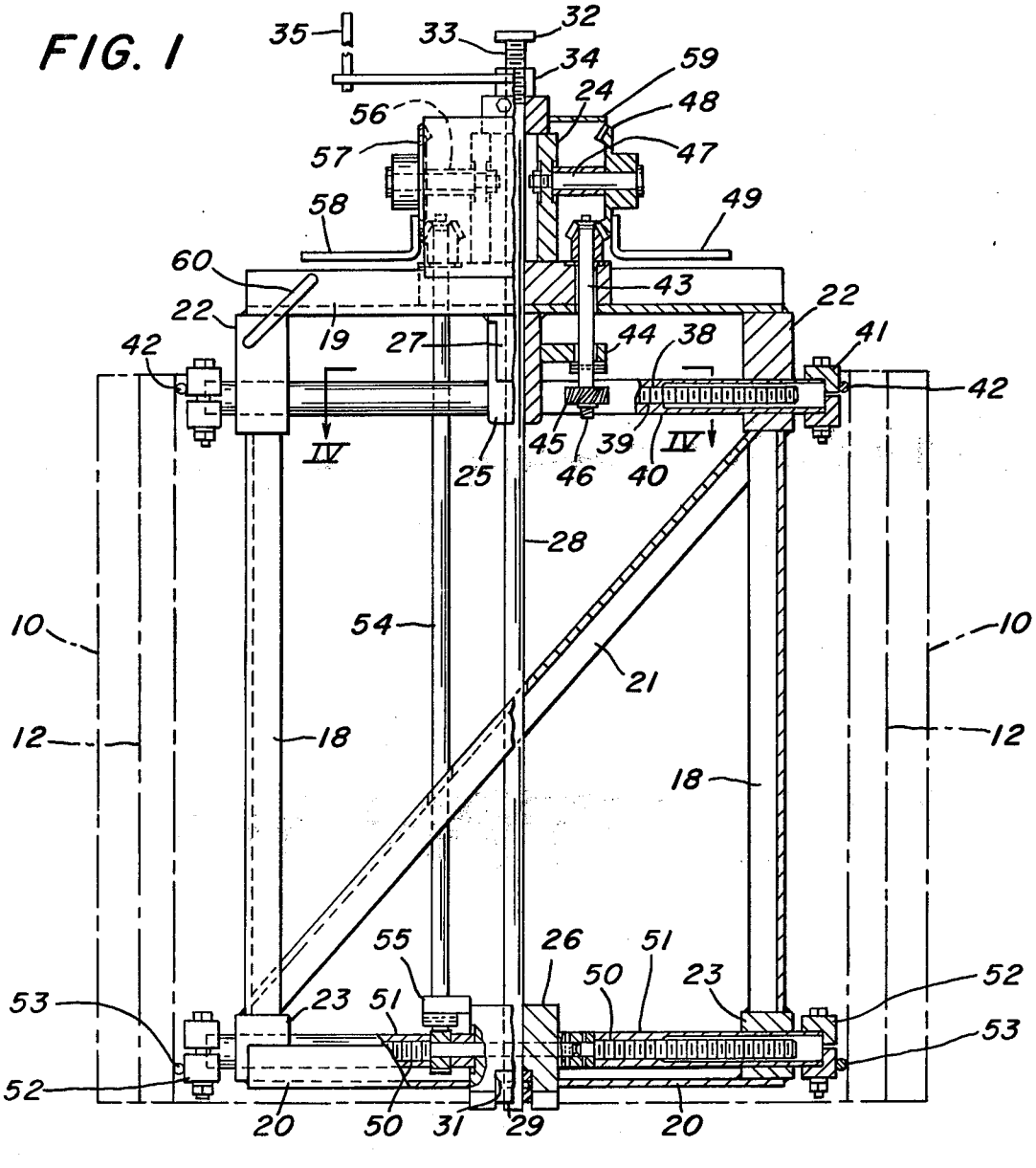
FIG. 1 is a side elevational view partly in section of the fixture inserted in a mold.
Figure 3:
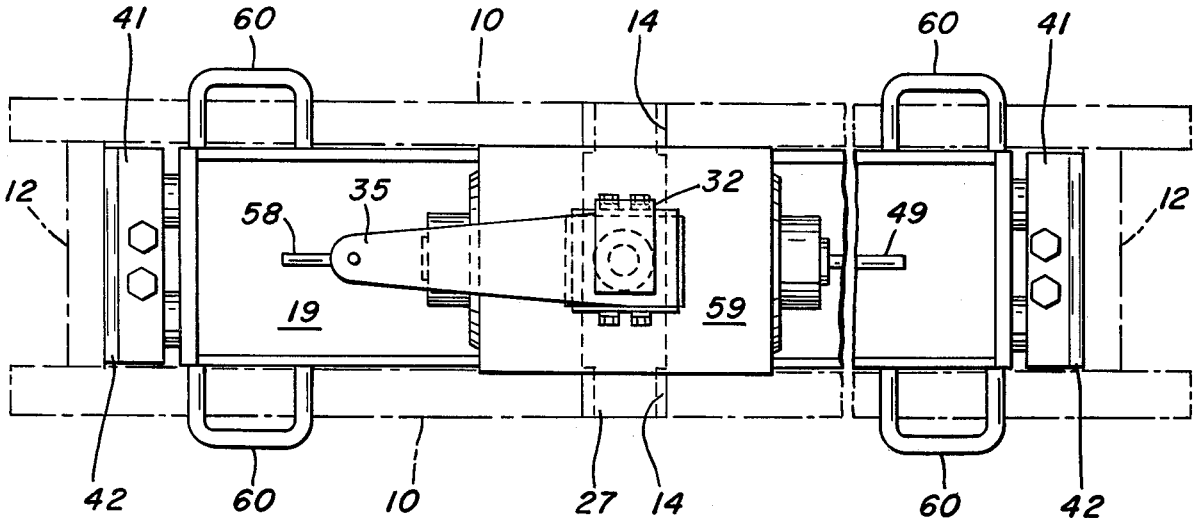
FIG. 3 is a top plan view of the fixture and mold.
Figure 4:
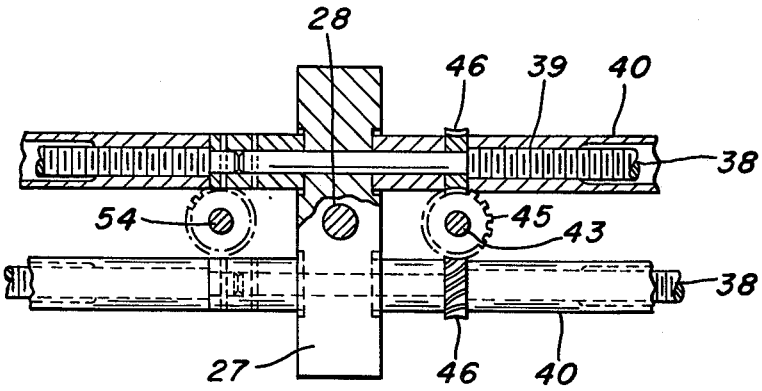
FIG. 4 is a horizontal section on line IV—IV of FIG. 1.

An upper pair of parallel horizontal shafts 38 are journaled in the upper bearing member 25 at opposite sides of the vertical shaft 28 (FIG. 4). Shafts 38 have right and left hand threaded portions 39 which engage internally threaded sleeves 40. The sleeves project through the upper corner blocks 22 and at their outer ends carry respective clamp bars 41 (FIG. 1). Respective horizontally extending positioning rods 42 are fixed to the outer faces of the clamp bars. A vertical shaft 43 is journaled in the housing 24 and in a bearing block 44 fixed to the upper bearing member 25. At its lower end shaft 43 carries a 45° helical gear 45 which meshes with similar gears 46 on shafts 38 for driving the latter shafts (FIG. 4). For turning shafts 43 and 38, a horizontal stub shaft 47 is journaled in the housing 24 and connected to shaft 43 through bevel gears 48. Shaft 47 carries a crank 49. Similarly a lower pair of parallel horizontal shafts 50 are journaled in the lower bearing sleeve 26 and engage threaded sleeves 51 which carry clamp bars 52 and positioning rods 53. A vertical shaft 54 is journaled in the housing 24 and in a bearing block 55 fixed to the lower bearing member 26 and drive shafts 50 through helical gears similar to gears 45 and 46. The vertical shaft 54 is turned with a stub shaft 56, bevel gears 57 and a crank 58 similar to parts already described. Preferably a cover 59 encloses the stub shafts 47 and 56 and bevel gears 57 and 48. Preferably also the fixture has handles 60 fixed to the frame to facilitate handling.

OPERATION

When an adjustment is to be made in the position of the end walls 12, I release the side walls 10 from clamping engagement with the end walls. I set both the top and bottom positioning rods 42 and 53 of the fixture to the proper spacing to abut the inside faces of the end walls 12 in their new positions to which they are to be adjusted. If the walls are to be tapered, I set the bottom positioning rods 53 closer to the vertical center line of the fixture than the top positioning rods. The rods are round in cross section, whereby they may abut the end walls evenly even through the walls taper and do not lie in vertical planes. I turn the cranks 49 and 58 to adjust the rods through the shafts 38 and 50. Rotation of these shafts of course moves the sleeves 40 and 51 axially and through equal distances by reason of the threaded engagement. Conveniently I can use suitable templates to adjust the positioning rods to the proper spacing.

I insert the fixture in the mold as shown in the drawings. The keyways 14 in the upper edges of the side walls 10 receive the top centering key 27. While the fixture passes through the mold as I insert it, the vertical shaft 28 and bottom centering key 29 are in their lower-most position relative to the bearing members 25 and 26, and I turn this shaft to place the key perpendicular to the keyway 31 so that the key clears the mold walls. After I insert the fixture, I turn the indicator bar 32 and vertical shaft 28 to align key 29 with the keyway 31. The cutouts 30 in the key provide clearance with the roll 13. Next I turn the crank 35 and nut 34 to pull the shaft 28 and key 29 upwardly into the keyways 15 and 31 in the lower edge of the side walls 10 and in the bearing member 26 respectively. Since the key enters keyways in both the side walls and the bearing member which is fixed to the frame, the fixture is held rigidly in the mold and the key is relieved of bending moments. After the end walls 12 are adjusted to their new positions abutting the positioning rods 42 and 53, I remove the fixture from the mold.

From the foregoing description, it is seen that my invention affords a fixture of simple construction which enables the end walls of a continuous-casting mold to be adjusted accurately and expeditiously. The positoning rods 42 and 53 are spaced accurately equidistant from the center of the fixture, and the fixture always is centered accurately when the keys 27 and 29 lie within their respective keyways. Hence the adjusted mold automatically is centered over the mold discharge rack. Preferably the fixture is of light weight metal to facilitate handling. The fixture may be used in adjusting either straight-sided molds or curved molds.

I claim:

1. A fixture for use in adjusting the positions of the end walls of a continuous-casting mold, said fixture comprising:

a frame adapted to be inserted in a mold;

means on said frame engageable with the mold side walls at their upper and lower edges for centering the frame with respect to the mold;

adjustable means carried by said frame at its opposite sides and adapted to abut the opposed adjustable end walls of the mold when the end walls are in the desired position of adjustment; and means carried by said frame for moving said adjustable means while maintaining the adjustable means at opposite sides of the frame equidistant from the center of the frame.

2. A fixture as defined in claim 1 in which the means for centering includes top and bottom transversely extending keys receivable in keyways formed in the mold side walls.

3. A fixture as defined in claim 2 in which said bottom key is moveable vertically and rotatably to enable it to clear the mold side walls as the fixture is inserted in the mold.

4. A fixture as defined in claim 1 in which said adjustable means includes positioning rods for abutting the mold end walls near both the top and bottom.

5. A fixture as defined in claim 4 in which said positioning rods are round in cross section to abut the end walls when they taper.

6. A fixture as defined in claim 4 in which the means for moving said adjustable means includes an upper pair of parallel horizontal shafts and a lower pair of parallel horizontal shafts, said shafts having right and left handed threaded portions, internally threaded sleeves receiving said threaded portions, and means for rotating said upper shafts and said lower shafts independently.

* * * * *